United States Patent [19]

Stepanenko et al.

[11] Patent Number: 4,599,880

[45] Date of Patent: Jul. 15, 1986

[54] METHOD OF MAKING METAL FIBERS AND APPARATUS FOR EFFECTING SAME

[75] Inventors: Alexandr V. Stepanenko; Leonid A. Isaevich; Ljudmila I. Moisinovich, all of Minsk, U.S.S.R.

[73] Assignee: Belorussky Politekhnichesky Institut, Minsk, U.S.S.R.

[21] Appl. No.: 557,156

[22] PCT Filed: Jan. 25, 1983

[86] PCT No.: PCT/SU83/00001

§ 371 Date: Nov. 10, 1983

§ 102(e) Date: Nov. 10, 1983

[87] PCT Pub. No.: WO83/03375

PCT Pub. Date: Oct. 13, 1983

[30] Foreign Application Priority Data

| | | | |
|---|---|---|---|
| Dec. 23, 1981 | [SU] | U.S.S.R. | 3362752 |
| Mar. 25, 1982 | [SU] | U.S.S.R. | 3403801 |
| Oct. 20, 1982 | [SU] | U.S.S.R. | 3499001 |
| Dec. 3, 1982 | [SU] | U.S.S.R. | 3514152 |

[51] Int. Cl.[4] ..... B21H 1/18

[52] U.S. Cl. ..... 72/94; 29/DIG. 31

[58] Field of Search ..... 425/78; 419/24, 43, 419/44; 29/DIG. 31; 72/99, 94, 110, 365, 366, 89

[56] References Cited

U.S. PATENT DOCUMENTS

| | | | |
|---|---|---|---|
| 2,279,347 | 4/1942 | Simons | 72/89 |
| 2,689,398 | 9/1954 | Gaut et al. | 29/DIG. 31 |
| 3,503,237 | 3/1970 | Marcovitch | 72/94 |
| 3,681,063 | 8/1972 | Douglass . | |

FOREIGN PATENT DOCUMENTS

| | | |
|---|---|---|
| 521067 | 10/1976 | U.S.S.R. . |
| 602304 | 3/1978 | U.S.S.R. . |

*Primary Examiner*—Lowell A. Larson

*Attorney, Agent, or Firm*—Burgess, Ryan & Wayne

[57] ABSTRACT

This invention relates to methods of making metal fibers and devices for effecting such methods.

A method of making metal fibers from spherical particles (6) of a metal powder to be practiced by an apparatus for making such metal fibers is proposed, the method residing in that the spherical particles (6) of metal powder are deformed by rolling each such spherical particle (6) along the path of the process and stretching this particle (6) along its axis of rotation between a main roll (2) and an additional roll (3) of a deforming tool (1). The stretching is executed at a rate exceeding the rate of plastic flow of metal in elongation during reducing the diameter of the deformable spherical particle (6), the additional roll (3) being used as a stretching device. The ready metal fibers (7) are then discharged.

14 Claims, 10 Drawing Figures

METHOD OF MAKING METAL FIBERS AND APPARATUS FOR EFFECTING SAME

FIELD OF THE INVENTION

This invention relates to the art of powder metallurgy, and more particularly to methods and apparatus for producing metal fibers.

BACKGROUND OF THE INVENTION

The powder metallurgy of today calls for improving the technological processes and poses high demands on the cost efficiency and quality of the end products obtained thereby. Porous materials are the subject of special attention in the art of powder metallurgy. In this connection, one very promising trend is the use of metal fibers instead of metal powders. However, a wider application of metal fibers in powder metallurgy is hindered by the lack of sufficiently simple and inexpensive production processes.

A cardinal solution to the problem may be offered by obtaining metal fibers directly from a metal powder by treating the powder mechanically.

There is known a method of making metal fibers from spherical particles of a metal powder (cf. International Application PCT/SU 82/00030, filed Sept. 15, 1982) comprising the steps of feeding the spherical particles of metal powder, subjecting these particles to deformation by rolling each of the particles in the path of the process and simultaneously stretching or elongating such a particle along the axis of its rotation, and discharging metal fibers thus obtained.

The same application further describes an apparatus for making metal fibers from spherical particles of a metal powder to practise the above method. The apparatus comprises a mechanism for feeding the spherical particles of metal powder provided with feeding passages, and a deforming or sizing tool which is comprised of one element having the form of a main roll and another element; the two elements of the deforming tool are disposed one relative to the other for rolling and stretching the spherical particles of metal powder being deformed, these particles being fed into a clearance between the two elements from the feeding passages of the feeding mechanism.

However, the above method and apparatus for making metal fibers suffers from a disadvantage in that for attaining a maximum possible ratio between the length and the diameter of fibers produced from the spherical particles of the metal powder limited exclusively by the plasticity of the metal of the particles an excessive number of rolling cycles is required. This results in reduced production efficiency and affects the plasticity of the metal of the powder particles due to cracks tending to develop therein. Stretching along the axis of rotation of the deformable spherical particles of metal powder fails to completely neutralize the braking effect of the contact friction forces directed in parallel to the axis of rotation toward the center of the fiber being formed and hampering the deformation of the particles, since the rate of such stretching fails to match with the rate of plastic flow of metal in elongation of the fiber.

SUMMARY OF THE INVENTION

The invention is directed toward the provision of a method of making metal fibers in which spherical particles of a metal powder would be stretched along the axes of their rotation at such a rate as to enable to increase the efficiency of the metal fiber production process with a maximum possible ratio of their length to their diameter. The invention is further directed toward the provision of an apparatus for practising the method having such a construction as to enable an increase in the efficiency of the metal fiber production process and ensure a maximum possible ratio between the length of the fibers and their diameter.

One aim of the invention has been attained by that in a method of making metal fibers from spherical particles of a metal powder by feeding the spherical particles, subjecting them to deformation by rolling each such particle in the path of the production process and simultaneously stretching each particle along the axis of its rotation, and discharging metal fibers thus obtained, according to the invention, stretching the deformable spherical particle of metal powder along the axis of its rotation is executed at a rate exceeding the rate of plastic flow of metal in elongation during reducing the diameter of this spherical particle.

Preferably, the excess of the rate of stretching of the deformable spherical particle of metal powder over the rate of plastic flow of metal in elongation during reducing the diameter of this particle is determined from the expression:

$$V_3 > (4/3)V_4(D^3/d^3),$$

where $V_3$ is the rate of stretching of the deformable spherical particle of metal powder along the axis of its rotation;

$V_4$ is the rate of radial reduction of the spherical particle of metal powder;

D is the diameter of the spherical particle; and d is the diameter of the metal fiber.

Advisably, simultaneously with stretching the spherical particle of metal powder along the axis of its rotation this deformable particle is moved in the plane of rolling in a direction perpendicular to the path of the production process.

The aim of the invention has also been attained by that in an apparatus for making metal fibers from spherical particles of a metal powder comprising a mechanism for feeding the spherical particles having feeding passages, and a deforming tool comprised of a main element in the form of a main roll and a second element, the two elements being disposed one relative to the other for rolling and simultaneously stretching the deformable spherical particles, the spherical particles of metal powder being supplied through the feeding passages of the feeding mechanism to a clearance between these two elements of the deforming tool, according to the invention, the apparatus is provided with a means for stretching each deformable particle of metal powder along the axis of its rotation at a rate exceeding the rate of plastic flow of metal in elongation during reducing the diameter of the spherical particle, this stretching means being connected to the deforming tool.

Preferably, one of the elements of the deforming tool serves as the means for stretching the deformable spherical particle of metal powder along the axis of its rotation at a rate exceeding the rate of plastic flow of metal in elongation during reducing the diameter of this spherical particle, this element having the form of an additional roll with a working surface shaped as a hyperboloid of revolution of variable radius R(x), the main roll and the additional roll being disposed so that their respective axes intersect to define therebetween an angle found from the expression:

$$\beta > \text{arc tg}\,\frac{D(2D^2 - 3d^2)(V_1 - V_2)}{12d^2R \cdot V_2 \sin\alpha},$$

where $V_1$ is the peripheral speed of the main roll 2;

$V_2$ is the peripheral speed of the additional roll;

R is the radius of the working surface of the main and additional rolls taken at the midpoint thereof; and $\alpha$ is the angle of contact of the deformable spherical particle with the main and additional rolls.

Advisably, the working surface of the main roll has the form of a hyperboloid of revolution of a variable radius R(x), whereas the angle of intersection of the axes of the main and additional rolls is determined from:

$$2\beta > \text{arc tg}\,\frac{D(2D^2 - 3d^2)}{6d^2R \cdot \sin\alpha}.$$

Preferably, the variable radius R(x) of the hyperboloid of revolution is determined from the expression:

$$R(x) = \sqrt{R^2 + x^2 tg^2\beta},$$

where x is the variable distance along the axes of the main and additional rolls on the two sides from the midpoint thereof.

Desirably, the means for stretching the deformable spherical particle of metal powder along the axis of its rotation at a rate exceeding the rate of plastic flow of metal in elongation during reducing the diameter of the spherical particle has the form of a mechanism for imparting reciprocating motions mechanically linked with the main roll and/or an element of the deforming tool capable of reciprocating motions.

Advisably, one of the elements of the deforming tool has the form of an additional cylindrical roll.

Preferably, the main roll of the deforming tool has the form of a cylinder.

Alternatively, one of the elements of the deforming tool has the form of a flat plate inclined between 70° and 80° to the horizontal in parallel with the axis of the horizontally disposed main cylindrical roll.

Preferably, the deforming tool further comprises a cylindrical portion the axis of which is horizontal, while the surface of this cylindrical portion having a curvature radius $$40D_{min} \leqq R_1 \leqq 60D_{min}$$

is connected to the top of a flat plate, the mechanism for feeding the spherical particles of metal powder being offset from the upmost point of the generating cylindrical surface toward the feeding path of the spherical particles into a clearance between the main cylindrical roll and the plate by 10° to 15° of an arc of a circle, the diameter of each feeding passage being $D_1 \leqq 4\,D_{min}$, the distance betwen the adjacent passages being $1 \geqq 40\,D_{min}$.

The present invention makes it possible to improve the efficiency of the fiber production process; the fibers obtained through the process having a maximum possible ratio between their length and diameter, this ratio being limited only by the margin of plasticity of the metal of the spherical particles being deformed.

BRIEF DESCRIPTION OF THE DRAWINGS

The invention will now be described in greater detail with reference to various specific embodiments thereof taken in conjunction with the accompanying drawings, in which.

BEST MODE OF CARRYING OUT THE INVENTION

A method of making metal fibers from spherical particles of a metal powder involves feeding the spherical particles, and subjecting them to deformation by causing each particle to roll in the direction of the process and simultaneously stretching such a particle along the axis of its rotation. The stretching of the spherical particle along the axis of its rotation is effected at a rate exceeding the rate of plastic flow of metal in elongation when the diameter of the spherical particle being deformed is reduced.

Preferably, the excess of the rate of stretching of the deformable spherical particle of metal powder along the axis of rotation thereof over the rate of plastic flow of metal in elongation when the diameter of the spherical particle is reduced can be determined from:

$$V_3 > (4/3)V_4(D^3/d^3),$$

where $V_3$ is the rate of stretching of the deformable spherical particle of metal powder along the axis of its rotation $V_4$ is the rate of radial reduction of the spherical particle;

D is the diameter of the spherical particle; and d is the diameter of the metal fiber.

For maximizing the length of metal fibers being made according to the method, the stretching of the deformable spherical particle of metal powder along the axis of its rotation is accompanied by moving this particle in the plane of rolling in a direction perpendicular to the path of the production process.

Figure 1:
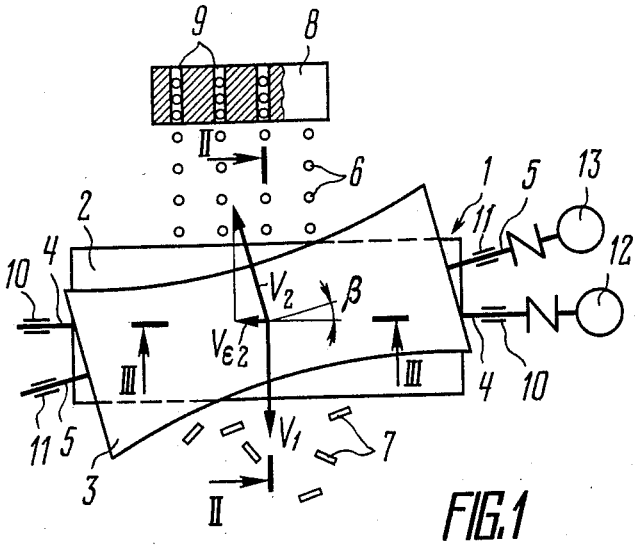
FIG. 1 is a schematic illustration of an apparatus for making metal fibers to practice the method of the invention, particularly an embodiment thereof in which one of the elements of a deforming tool has the form of an additional roll with a working surface shaped as a hyperboloid of revolution.

Referring now to FIG. 1 of the drawings, there is shown an apparatus for effecting the method of the invention, which apparatus comprises a deforming tool generally indicated by 1 comprised of two elements fashioned as a main roll 2 (FIGS. 1, 2 and 3) and an additional roll 3 with working surfaces in the form of hyperboloids of revolution. The rolls 2, 3 are disposed so that their respective axes 4 and 5 intersect to define therebetween an angle which can be determined from the expression:

$$\beta > \text{arc tg}\,\frac{D(2D^2 - 3d^2)(V_1 - V_2)}{12d^2R \cdot V_2 \sin\alpha},$$

where

D is the diameter of the spherical particle 6 of the metal powder;

d is the diameter of the metal fiber 7;

$V_1$ is the linear velocity of the main roll 2;

$V_2$ is the linear velocity of the additional roll 3;

R is the radius of the working surface of the main roll 2 and the additional roll 3 at midpoint thereof; and $\alpha$ is the angle of contact of the deformable spherical particle 6 with the main and additional rolls 2 and 3.

Therewith, the variable radius of the hyperboloid of revolution is found from:

$$R(x) = \sqrt{R^2 + x^2 tg^2\beta},$$

where x is the variable distance along the axes 4 and 5 of the main roll 2 (or 14) and the additional roll 3, respectively, on the two sides from their midpoint.

The apparatus according to the invention is provided with a means for stretching the deformable spherical particle of metal powder along the axis of its rotation at a rate exceeding the rate of plastic flow of metal in elongation during reducing the diameter of the deformable spherical particle, the additional roll 3 functioning as the above means.

Also represented in FIG. 1 are vectors of peripheral speeds $V_1$, $V_2$ and vectors of tangential speeds $V\tau_1$, $V\tau_2$ of the rolls 2 and 3, respectively.

The spherical particles 6 of the metal powder are fed to a clearance between the rolls 2 and 3 from a feeding mechanism 8 through passages 9. The metal fibers 7 exit from the opposite side of the rolls 2 and 3. The rolls 2 and 3 are journalled in bearings 10 and 11; drives 12 and 13 being mechanically connected to the rolls 2 and 3.

Figure 3:
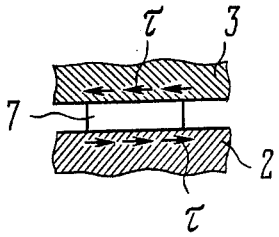
FIG. 3 is a section taken on the line III—III in FIG. 1.

Represented in FIG. 3 are direction vectors of the forces $\tau$ of friction at the points of contact between the surfaces of the fiber 7 and the rolls 2, 3.

According to another modification of the apparatus for making metal fibers to effect the proposed method, the working surface of the main roll 14 (FIG. 4) has the form of a hyperboloid of revolution with variable radius R(x) substantially similar to the one described heretofore. The angle between axes 15 and 5 of the rolls 14 and 3, respectively, can be determined from the expression:

$$2\beta > \text{arc tg}\,\frac{D(2D^2 - 3d^2)}{6d^2R \cdot \sin\alpha}.$$

Figure 4:
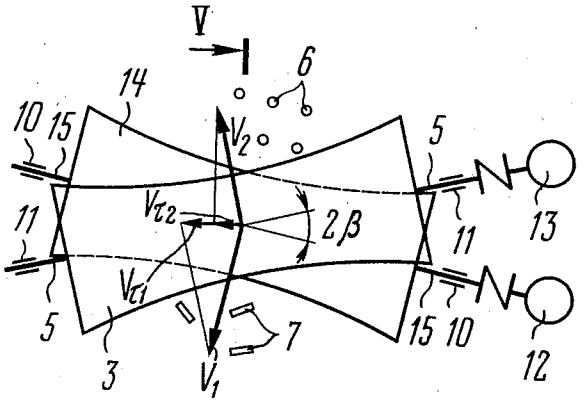
FIG. 4 shows a schematic illustration of an apparatus for effecting the method of the invention in which the working surface of the main roll has the form of a hyperboloid of revolution.
Figure 5:
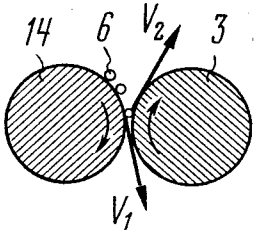
FIG. 5 is a section taken on the line V—V in FIG. 4.

FIGS. 4 and 5 represent vectors of peripheral speeds $V_1$, $V_2$ and vectors of tangential speeds $V\tau_1$, $V\tau_2$ of the main and additional rolls 14 and 3, respectively.

Figure 6:
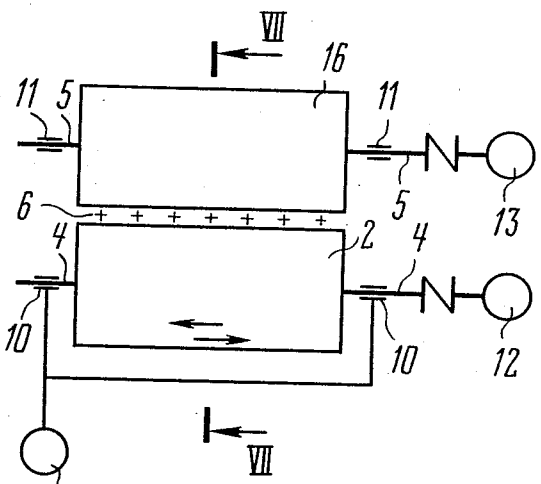
FIG. 6 is an alternative embodiment of the apparatus for making metal fibers to practise the method of the invention in which a mechanism for imparting reciprocating motions is provided.

According to yet one more modified form of the apparatus for making metal fibers to practise the proposed method, the second element of the deforming tool 1 has the form of a generally cylindrical roll 16 as seen best in FIG. 6. Used as the means for stretching the deformable spherical particle of metal powder along its axis of rotation at a rate exceeding the rate of plastic flow of metal in elongation during reducing the diameter of the deformable particle is a mechanism 17 for imparting reciprocating motion to the roll 2 mechanically connected to the bearings 10.

Figure 7:
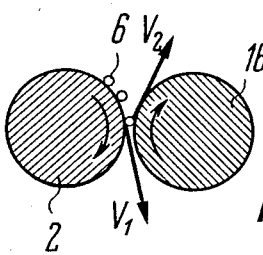
FIG. 7 is a section taken along the line VII—VII in FIG. 6.

FIG. 7 represents vectors of peripheral speeds $V_1$, $V_2$ of the main and additional rolls 2 and 16, respectively, of the deforming tool 1 shown in FIG. 6.

Figure 9:
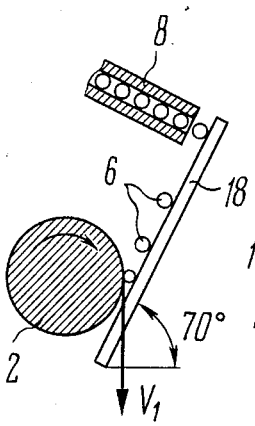
FIG. 9 is a view taken along the arrow A in FIG. 8.
Figure 8:
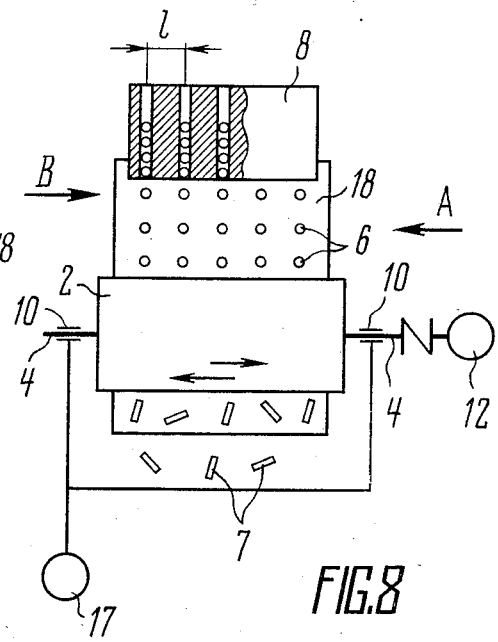
FIG. 8 is a modified form of the apparatus for making metal fibers according to the method of the invention in which a second element of the deforming tool is fashioned as a plate.

With reference to FIGS. 8 and 9, in an alternative modification of the apparatus for effecting the method of the invention the second element of the deforming tool 1 has the form of a flat plate 18 arranged at an angle of 70° to the horizontal and in parallel with the axis 4 of the horizontally disposed main cylindrical roll 2.

Figure 10:
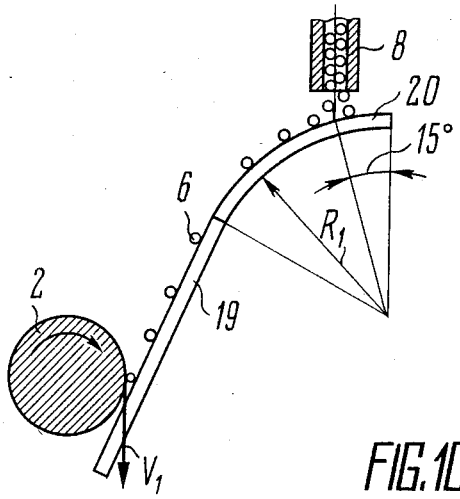
FIG. 10 is a view taken along the arrow B in FIG. 8.

In the last preferred modification of the apparatus for making metal fibers to practice the method of the invention illustrated in FIG. 10 the deforming tool 1 comprises a portion of the cylinder the axis of which is horizontal, while a surface 20 having a curvature radius $$40D\ \text{min} \leqq R_1 \leqq 60D\ \text{min}$$

is joined with the top of a flat plate 19.

The mechanism 8 for feeding the spherical particles of metal powder is somewhat offset from the upmost point of the generating surface 20 toward the path of rolling of the particles 6 into a clearance between the roll 2 and the plate 19 an angle of 15°. The diameter of each passage 9 for feeding the spherical particles is $D_1 \leqq 4D$ min, whereas the adjacent passages 9 are spaced a distance $1 \geqq 40D$ min.

Figure 2:
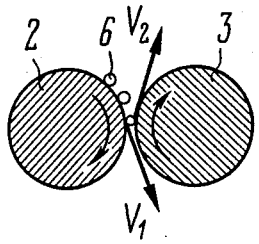
FIG. 2 is a section taken on the line II—II in FIG. 1.

The fiber making apparatus for effecting the method of the invention as illustrated in FIGS. 1, 2 and 3 functions as follows.

The drives 12 and 13 are engaged to rotate the main cylindrical roll 2 and additional roll 3 in one direction but at different peripheral speeds $V_1$ and $V_2$. The spherical particles 6 of metal powder are conveyed from the feeding mechanism 8 through the passages 9 to a clearance between the rolls 2 and 3 of the deforming tool 1. The provision of the greater peripheral speed $V_1$ of the roll 2 as compared with the speed $V_2$ of the roll 3 makes it possible, along with rolling, to draw the particles 6 into the clearance between the rolls 2 and 3 to result in a subsequent travel thereof along the path of the process. While moving in the clearance between the rolls 2 and 3 in the direction of the fiber making process, the particles 6 are deformed by virtue of being rolled and stretched. The stretching is effected at a rate exceeding the rate of plastic flow of metal in elongation during reducing the diameter of the particles 6. This rate can be found from the expression:

$$V_3 > (4/3)V_4(D^3/d^3),$$

where $V_3$ is the rate of stretching of the deformable spherical particle 6 along the axis of its rotation;

$V_4$ is the rate of radial reduction of the spherical particle 6;

D is the diameter of the spherical particle 6; and d is the diameter of the fiber 7.

The particles 6 are deformed until fibers 7 are made, the diameter of these fibers corresponding to the minimum clearance between the rolls 2 and 3.

Because the axis 5 of the roll 3 is turned relative to the axis 4 of the roll 2 at an angle determined from:

$$\beta > \text{arc tg}\,\frac{D(2D^2 - 3d^2)(V_1 - V_2)}{12d^2R \cdot V_2 \sin\alpha},$$

where

R is the radius of the working surface of the main roll 2 and the additional roll 3 if measured at midpoint of each of these rolls; and $\alpha$ is the angle of contact of the deformable particle 6 with the rolls 2 and 3, while the generating surfaces of these rolls 2 and 3 in the zone of the least clearance therebetween are parallel, a tangential component $V\tau_2$ of the peripheral speed $V_2$ occurs. This tangential component $V\tau_2$ facilitates stretching the particle 6 along the axis of its rotation. The value of $V\tau_1$ grows as the angle $\beta$ of turn of the axes 4 and 5 of the rolls 2 and 3 increases. Since the tangential component $V\tau_1$ of the peripheral speed $V_1$ on the roll 2 is zero, then by varying the angle $\beta$ of turn of the axes 4 and 5 of the rolls 2 and 3, respectively, the forces $\tau$ of contact friction on the rolls 2 and 3 tend to be directed oppositely. The deformable particle 6 is therefore stretched by the active forces $\tau$ of contact friction in the direction of the tangential component $V\tau_2$ of the peripheral speed $V_2$ on the shaft 3, because the value of the component $V\tau_2$ is greater than the rate of plastic flow of the metal in elongation when the diameter of the particle 6 is reduced. This facilitates the formation of the fibers 7 and increases the efficiency of the process.

The apparatus for making fibers illustrated in FIGS. 4 and 5 operates as follows.

The apparatus is started and the particles 6 are fed to a clearance between the main roll 14 and the additional roll 3 as heretofore described. When the axis 15 of the roll 14 is turned relative to the axis 5 of the roll 3 at an angle determined from:

$$2\beta > \text{arc tg}\,\frac{D(2D^2 - 3d^2)}{6d^2R \cdot \sin\alpha}$$

in the plane of escape of the fibers 7 from the clearance between the rolls 14 and 3, the generating lines of these rolls 14 and 3 are maintained in the parallel position. Therewith, a tangential component $V\tau_1$ of the peripheral velocity $V_1$ directed toward the same side as the component $V\tau_2$ on the roll 3. The difference between these speeds $V\tau_1$–$V\tau_2$ provokes a force causing the deformable particle 6 to stretch in the direction coinciding with the axis of its rotation. In order to neutralize the force of contact friction in the direction of stretching of the deformable particle 6 by varying the value of the angle $2\beta$ between the rolls 14 and 3, a difference between the speeds $V\tau_1$ and $V\tau_2$ is selected such that it would be greater than the rate of plastic flow of metal in elongation when the diameter of the deformable particle 6 is reduced. The similarity in the direction of the speed vectors $V\tau_1$ and $V\tau_2$ causes displacement of each particle 6 in the course of their deformation along the generating lines of the rolls 14 and 3 at a speed $V\tau_2$ to provide for distribution of the particles 6 along their axis of rotation. This precludes the adjacent particles 6 from running on each other in the direction of their elongation, whereby the process of formation of the fibers 7 is facilitated and the efficiency of the process is increased.

The apparatus shown in FIGS. 6 and 7 operates in the following manner.

The drives 12 and 13 are energized to rotate the main and additional cylindrical rolls 2 and 16 in the same direction at different velocities $V_1$ and $V_2$. Simultaneously, the mechanism for imparting reciprocating motion to the roll 2 is engaged to transmit through the mechanical linkage and the bearings 10 this motion to the roll 2. Otherwise, the apparatus functions as described heretofore. The shape of the rolls 2 and 16 provides for their simplified manufacture, whereas the provision of axial reciprocations of the roll 2 facilitates the formation of the fibers 7 and speeds up the fiber making process.

The apparatus for making metal fibers illustrated in FIGS. 8 and 9 operates as follows.

The drive 12 is engaged to rotate the roll 2 in the direction of the process and simultaneously the mechanism 17 is actuated from which axial reciprocating motion is transmitted to the roll 2 through the bearings 10. The particles 6 are fed between the roll 2 and plate 18 of the deforming tool 1. The angle of inclination of the plate 18 to the horizontal is between 70° and 80°; a smaller angle between the plate 18 and the horizontal results in reduced speed at which the particles are fed between the plate 18 and the roll 2 to affect the efficiency of the apparatus. Otherwise, the apparatus functions similarly to what has been with reference to the previously described embodiments.

For a more efficient distribution of the spherical particles 6 fed from the mechanism 8 to the clearance between the roll 2 and the plate 19 (FIG. 10), these particles 6 are supplied from the passages 9 to the cylindrical surface 20, the particles 6 thus being able to freely fall onto this surface. After colliding with the surface 20 the particles 6 tend to scatter therealong.

The provision in this last embodiment of the cylindrical surface 20 at the top of the plate 19 enables to use the mechanism 8 for feeding the particles 6 of various diameters.

The invention makes it possible to obtain metal fibers of higher quality.

INDUSTRIAL APPLICABILITY

The invention can find application for fabricating working elements of filters and mixers of gases and liquids, mechanical and sonic vibration dampers, refractory porous articles, etc.

We claim:

1. A method of making metal fibers from spherical particles of a metal powder, comprising the steps of:

feeding said spherical particles of metal powder;

deforming said spherical particles by rolling over each of said spherical particles so that said spherical particles roll along a rolling axis thereof, while moving in a direction perpendicular to the rolling axis;

stretching each said particle being deformed along said rolling axis thereof, which coincides with the longitudinal axis of said metal fiber being formed, by contact friction forces;

simultaneously performing said stretching in said deforming step;

carrying out said stretching at a rate exceeding the rate of elongation of each said particle being deformed that would be achieved by a decrease in the diameter of said particle as a result of said rolling over alone; and unloading said metal fibers.

2. A method according to claim 1, further including the step of determining said rate of stretching of said particles being deformed from the expression $$V_3 > (4/3)V_4(D^3/d^3),$$

where $V_3$ is the rate of stretching of each spherical particle being deformed by contact friction forces along said rolling axis which coincides with the longitudinal axis of the fiber being formed;

$V_4$ is the rate of radial reduction of the spherical particles of metal powder;

D is the diameter of the spherical particles of metal powder; and d is the diamter of the metal fibers.

3. A method according to claim 2, comprising the step of moving each said spherical particle being deformed in the plane of rolling thereover, in the direction of said rolling axis, which is effected simultaneously with said stretching of the spherical particle being deformed.

4. A method according to claim 1, comprising the step of moving each said spherical particle being deformed in the plane of rolling thereover, in the direction of said rolling axis, which is effected simultaneously with said stretching of the spherical particle being deformed.

5. An apparatus for making metal fibers from spherical particles of a metal powder, comprising:

a mechanism having feeding passages for feeding the spherical particles of metal powder;

a deforming tool including a first element in the form of a main roll having a working surface and a second element;

a clearance being provided between said first and second elements for receiving and deforming said spherical particles fed from said feeding passages of said feeding mechanism;

said first and second elements being disposed relative to each other for rolling over and simultaneously stretching said spherical particles; and means for stretching each said spherical particle being deformed by contact friction forces along the rolling axis thereof which coincides with the longitudinal axis of said fiber being formed, at a rate exceeding the rate of elongation of said fiber being deformed that would be achieved by a decrease of its diameter as a result of said rolling over alone, said means being integrated with the deforming tool.

6. An apparatus according to claim 5, wherein said means for stretching is said second element of the deforming tool made in the form of an additional roll having a working surface;

said working surface of the additional roll being a hyperboloid of revolution of a variable radius R(x);

said main roll being cylindrical;

said main and additional rolls having identical directions of rotation but different peripheral speeds and are so arranged that their axes intersect at an angle $\beta$ formed from the expression $$\beta > \text{arc tg}\,\frac{D(2D^2 - 3d^2)(V_1 - V_2)}{12d^2 \cdot R \cdot V_2 \sin\alpha},$$

where $V_1$ is the peripheral speed of said main roll;

$V_2$ is the peripheral speed of said additional rool;

R is the radius of said working surfaces of the main and additional rolls at midpoints thereof; and $\alpha$ is the angle of contact of said spherical particle being deformed with said main and additional rolls.

7. An apparatus according to claim 6, wherein said variable radius R(x) of said hyperboloid of revolution is determined from the expression $$R(x) = \sqrt{R^2 + x^2 tg^2},$$

where

X is the variable distance along said axes of said main and additional rolls to both sides off the midpoints thereof.

8. An apparatus according to claim 5, wherein said means for stretching is said second element of the deforming tool made in the form of an additional roll having a working surface; said working surfaces of said main and additional rools are made in the form of hyperboloids of revolution of a variable radius R(x), and the angle $2\beta$ between their intersecting axes is $$2\beta > \text{arc tg}\,\frac{D(2D^2 - 3d^2)}{6d^2 \cdot R \cdot \sin\alpha};$$

said rolls having similar directions of rotation but different peripheral speeds.

9. An apparatus according to claim 8, wherein said variable radius R(x) of said hyperboloid of revolution is determined from the expression $$R(x) = \sqrt{R^2 + x^2 tg^2\beta},$$

where x is the variable distance along said axes of said main and additional rolls to both sides off the midpoints thereof.

10. An apparatus for making metal fibers from spherical particles of metal powder, comprising:

a mechanism having feeding passages for feeding the spherical particles of metal powder;

a deforming tool including a first element in the form of a main roll having a working surface and a second element;

a clearance being provided between said first and second elements for receiving and deforming said spherical particles fed from said feeding passages of said feeding mechanism;

said first and second elements being disposed relative to each other for rolling over and simultaneously stretching said spherical particles; and means for stretching each said spherical particle of metal powder being deformed by contact friction forces along the rolling axis thereof which coincides with the longitudinal axis of said fiber being formed, at a rate exceeding the rate of elongation of said fiber being deformed that would be achieved by a decrease of its diameter as a result of said rolling over alone, said means being kinematically coupled with said deforming tool.

11. An apparatus according to claim 10, wherein said means for stretching the spherical particles being deformed is made in the form of a mechanism for imparting reciprocating motion to at least one of said elements of the deforming tool in the direction of the axis of said main roll relative to another of said elements.

12. An apparatus according to claim 11, wherein said second element of the deforming tool is made as an additional roll, said main and additional rolls being of a cylindrical shape.

13. An apparatus according to claim 11, wherein said second element of the deforming tool is made in the form of a flat plate arranged at an angle of 70°-80° to the horizontal and parallel to said axis of the main horizontally arranged roll;

and said main roll being cylindrical.

14. An apparatus according to claim 13, including:

a portion of a cylindrical surface mating with an upper part of said flat plate;

said cylindrical surface having generatrixes arranged horizontally, and a radius of curvature $R_1$ determined by the ratio $$40D_{min} \leqq R_1 \leqq 60D_{min},$$

where $D_{min}$ is the minimum diameter of said spherical particles;

said mechanism for feeding spherical particles being offset from said generatrix of said cylindrical surface in the direction of feed of said spherical particles by an arc of approximately 10°-15°;

said feeding passages each having a diameter determined by the ratio $D_1 \leqq 40D_{min}$; and adjacent passages being spaced apart a distance along said generatrix determined by the ratio of $1 \leqq 40D_{min}$.

* * * * *